United States Patent [19]

Ruthven

[11] Patent Number: 5,058,869

[45] Date of Patent: Oct. 22, 1991

[54] CABLE VISE

[76] Inventor: Ronald L. Ruthven, 45 E. Valleybrook Rd., Long Valley, N.J. 07853

[21] Appl. No.: 605,924

[22] Filed: Oct. 30, 1990

[51] Int. Cl.[5] ..... B25B 1/20

[52] U.S. Cl. ..... 269/45; 269/97; 269/64; 269/268; 269/228

[58] Field of Search ..... 269/96–98, 269/45, 43, 64, 228, 268, 903; 81/54, 55, 462

[56] References Cited

U.S. PATENT DOCUMENTS

| | | | |
|---|---|---|---|
| 1,352,647 | 9/1920 | Benton | 269/97 |
| 3,837,633 | 9/1974 | Paulsen | 269/94 |
| 4,108,589 | 8/1978 | Bunch | 269/268 |
| 4,673,174 | 6/1987 | Taffert | 269/268 |
| 4,858,901 | 8/1989 | Okuyama et al. | 269/268 |

*Primary Examiner*—Robert C. Watson
*Attorney, Agent, or Firm*—Benasutti

[57] ABSTRACT

An adjustable angle vise is provided for clamping a cable to a fixed structure in order to free the hands of a person making cable connections. The vise comprises two vise-grip pliers, with the pincers of one having flat resilient blocks adapted to grip a fixed structure, and the pincers of the other having resilient blocks with varied diameter channels to grip a cable. The two pliers can be connected together at varied angles by toothed connecting hubs. The cable-gripping pliers has at least two such hubs oriented perpendicular to each other, to allow orienting the cable either along or perpendicular to the fixed structure.

1 Claim, 1 Drawing Sheet

CABLE VISE

FIELD OF THE INVENTION

This invention is related to the field of hand tools for installing electrical cable; in particular to an adjustable angle vise for clamping the cables in position while the installer makes terminal, splice or elbow connections.

BACKGROUND OF THE INVENTION

Electrical utility companies distribute electrical power from generation stations to residential users along overhead and underground cable networks. The power cables are relatively thick, inflexible and heavily insulated compared to the two-conductor domestic cable used for the distribution circuits inside residence and office buildings, and are commensurately more difficult to handle while making connections. A typical cable may have a center core conductor of quarter inch diameter, surrounded by insulation and a semi-conducting jacket, with several neutral wire strands spaced in a concentric pattern around the jacket and themselves enclosed by an outer sheaf protective jacket.

It is difficult for a single installer to make connections. He is frequently working on a pole, aerial lift or in a ditch where his movement is limited. He has to position, measure and cut the cable, strip the outer jacket, gather and twist the neutral wires into a single conductor, cut away the semi-conducting jacket and insulation to expose the center core conductor, crimp or twist an appropriate connector to the core, make the connection and wrap it with an insulating cover. Much of the time he will be working with one hand, as the other is occupied with holding the cable. The razor sharp blades used to open the jackets and cut away insulation, and the cable cutting and crimping tools can, and too frequently do, cause accidental injuries because of the required one-hand operation.

In view of this background, it would be beneficial to the installer to provide him with a device which enables him to clamp a length of cable in a desired position and thereby free both hands to prepare and make the cable connections. Such device should be capable of attachment to any suitable fixed structure in the vicinity, yet able to clamp the cable at any angle to the structure. It should further be small enough for use in narrow confines, light enough to be carried while climbing a ladder or pole, easy to install, adjust and use, and should not damage the cable.

BRIEF SUMMARY OF THE INVENTION

The above objectives are addressed by a cable clamp which comprises two vise-grip pliers adapted to be joined to each other at a variety of angles. One of the pliers has resilient flat blocks mounted on swivel joints at the ends of its pincer arms to provide a clamped attachment to fixed structure of various size, shape and composition. The other pliers has resilient blocks with varied diameter channels at the ends of its pincer arms to provide a vise for tightly gripping cables of various diameter without damaging the cable. The two pliers can be connected together at a variety of angles with respect to each other by one or more adjustable angle connectors. In the preferred embodiment, the connectors comprise two toothed hubs mounted in different planes on one arm of the flat block pliers, each having a slot for a threaded connector bolt, and on one arm of the cable block pliers a single mating toothed hub with a threaded center bore to receive the connector bolt.

DETAILED DESCRIPTION

Figure 1:
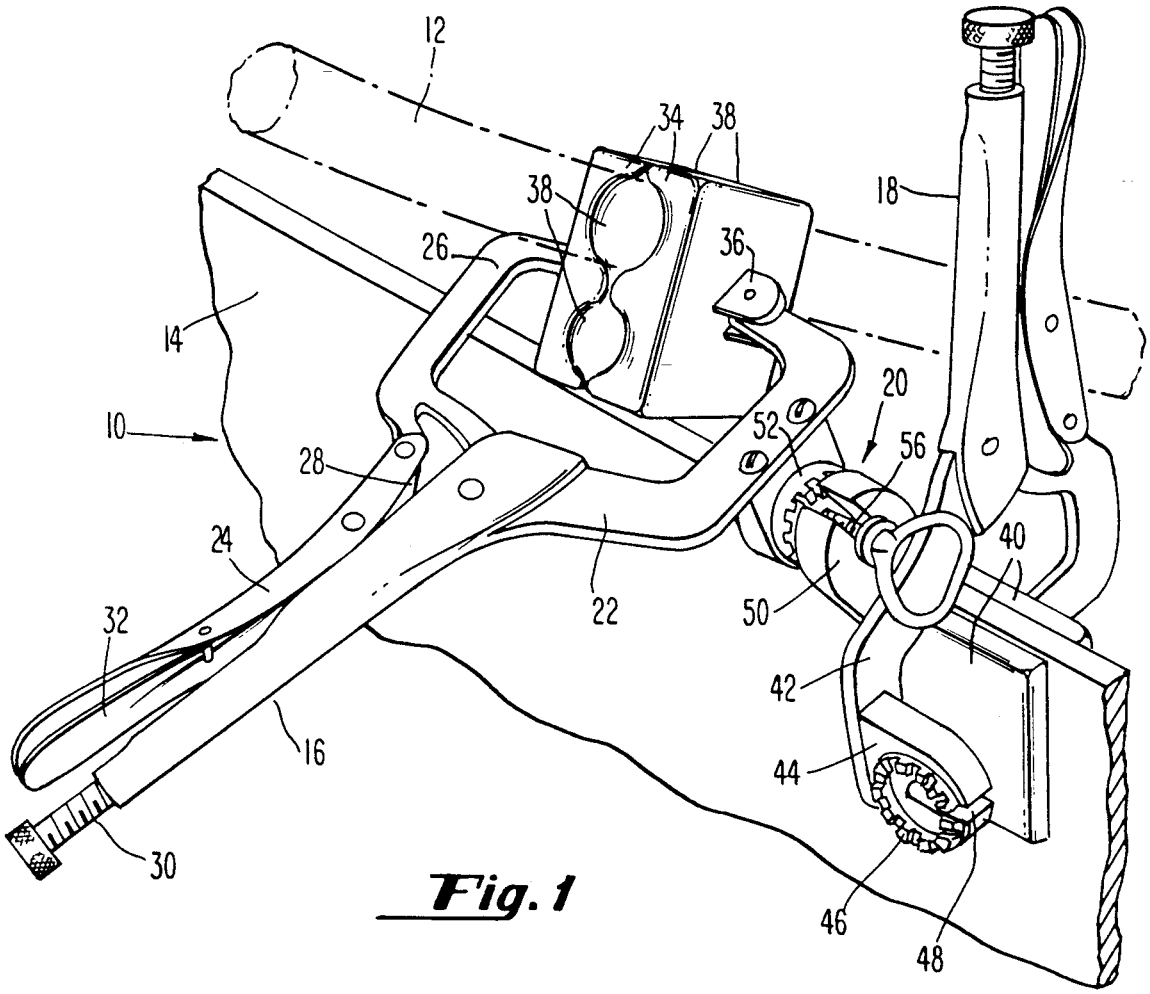
FIG. 1 is a perspective view of a cable vise according to the invention depicted in position on a fixed structure and clamping a cable at a selected angle.

FIG. 1 depicts a cable vise 10 holding a length of cable 12 and clamped to a fixed structure 14. The vise 10 includes two specially modified vise-grip pliers 16, 18 joined by an adjustable angle connector 20 to hold the cable firmly in the selected orientation.

Except for the structure added to make the adjustable angle connector, the cable-holding pliers 16 is a commercially available device used to clamp hydraulic hose while coupling sockets are turned onto the hose with a wrench. It has common features of a vise-grip pliers; that is, a fixed or rigid handle and arm 22, a grip lever 24 pivotally attached to a movable pincer arm 26, a gap adjustment spring 28 attached to a jack screw 30 in the handle to vary spring tension and thus adjust the pincer gap, and a release lever 32. It is modified to clamp hose by providing resilient blocks 34 on pinned pivot joints 36 at the ends of the pincer arms. The blocks 34 are made resilient by a plastic surface, most likely dip-coated onto the blocks by the manufacturer. The blocks have semi-circular channels 38 of different diameters, two on each side of the block, and when brought together by the pliers thus form four different diameter circular grips. While the device was apparently designed to grip hose, the previously described electrical cables have similar diameters and the resilient circular grip is well suited for gripping a cable tightly without damaging it.

The fixed structure clamping pliers 18 is similar to the cable-holding pliers 16, except that resilient flat blocks 40 are pin-pivotally attached to the pincer arms. The blocks 40 provide a grip on any suitable fixed structure, since the resilient plastic surface will grip angled or rounded structure if no flat structure is convenient, will hold against smooth or rough surfaces, and will not mar the finish of a painted or polished surface.

Two adjustable angle connector hubs are mounted on the fixed pincer arm 42 of the structure clamp pliers 18. A flange 44 is riveted to one side of the fixed arm 42 intermediate the span of the arm, and extends away from the arm in the same plane (approximate) as the flat blocks 40. While not depicted in FIG. 1, it can easily be understood that this connector hub will be used when it is desired to clamp the cable in the same plane as the fixed structure. An eleven toothed hub 46 is machined onto the flange 44, with the individual teeth evenly spaced at 30 degrees of arc, as if there were twelve teeth. A bolt slot 48 is cut into the flange 44 at the point most remote from the arm 42, where the twelfth tooth would have been centered. As will be described, the mating hub on the cable holding pliers has twelve evenly spaced teeth, and thus the connector hubs provide 360 degrees of rotation in thirty degree increments. A second connector hub 50 is identical to the one just described, except that it is mounted on the opposite side of the arm 42 near the junction with the handle, and extends its toothed hub in a plane perpendicular to the plane of the blocks 40. This hub is used when the cable must be clamped in a plane perpendicular to the fixed structure, as in FIG. 1.

Figure 2:
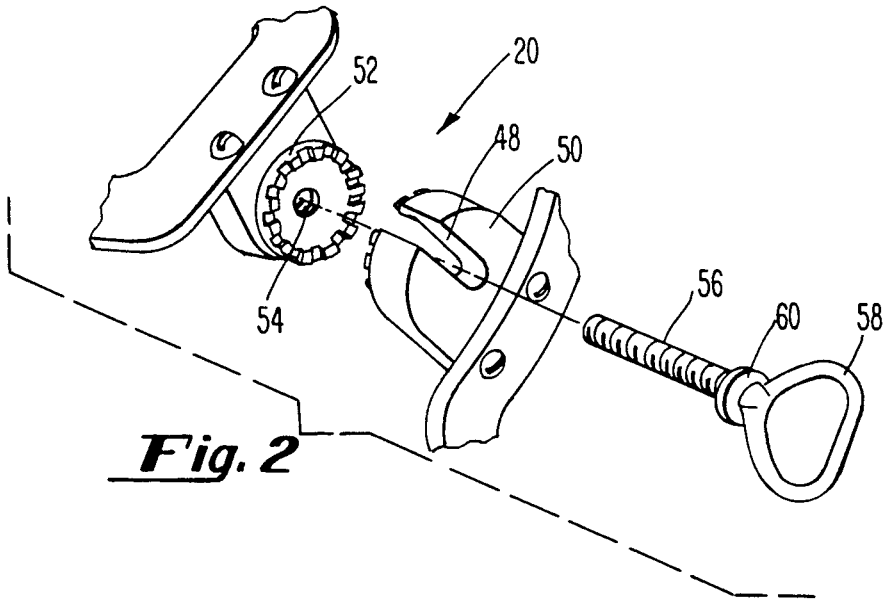
FIG. 2 is an exploded view of the toothed connector hubs and connector bolt identified by like numerals in FIG. 1.

The cable-holding pliers 16 has a single twelve-toothed connector hub 52 bolted to the fixed pincer arm 22 intermediate the arm's span, corresponding to the position the hub flange 44 on arm 42. Hub 52 has a threaded center bore 54 to receive a threaded bolt 56, as shown in FIG. 2. The bolt has a finger handle 58 to assist turning, and a rim 60 above the threads to engage the sides of the slot 48 and lock the meshed connector hubs together.

Industrial Applicability

The depicted and described cable vise will be used by electrical utility crews to clamp cable lengths in position for connection to free the installer to use both hands to prepare the cables for connection and to make the connection. An installer can carry the two vise grip members 16,18 and the connecting bolt 56 up a ladder or in an aerial lift or ground ditch where the connection will be made. He will chose any suitable fixed structure sufficiently close to the connection point, such as the rim of the lift bucket or a spacer board in a ditch, and attach the vise grip 18 to it. He will then pull a length of cable into position and attach to it the vise grip 16. He will then mesh the connecting hub 52 on the cable pliers with the appropriate hub on the structure pliers, depending on the plane of the cable relative to the structure, and use the bolt 56 to lock the hubs at the desired angle within the thirty degree increments provided.

The installer will now have the cable locked in position and can use both hands to measure and cut to length, strip the insulation and prepare the strands, crimp or twist on the connector lugs, make and wrap the connection. He can then remove the cable vise, pull out any cable slack, and attach any required cable 15 supports.

While the invention has been described by reference to the preferred embodiment depicted in the drawings, minor variations may be possible which are still consistent with the scope of the invention. Readers are therefore urged to review the claims which follow to determine the scope of the invention.

What is claimed:

1. An adjustable angle vise for clamping a cable to a fixed structure, said vise comprising:

(a) a first plier means having pincers adapted to clamp said plier means to a fixed structure;

(b) a second plier means having pincers adapted to grip a cable;

(c) adjustable angle connector means for connecting the second plier means to the first plier means at selected angles between the two plier means, said adjustable angle connector means comprising toothed hubs mounted on each plier means, each of said hubs having a plurality of teeth spaced evenly apart in a circular pattern, said hubs being adapted to be locked together such that the teeth of one hub are meshed with the teeth of another hub, and (d) wherein two of said toothed hubs are mounted on the first plier means, and the circular pattern of teeth on one of the two hubs is oriented in a plane which is perpendicular to the plane in which the circular pattern of teeth on the other hub is oriented.

* * * * *